United States Patent [19]

Widdershoven

[11] 4,213,406

[45] Jul. 22, 1980

[54] DRAFT INTERRUPTER OF A GAS-FIRED BOILER INSTALLATION

[75] Inventor: Louis H. Widdershoven, Kerkrade-West, Netherlands

[73] Assignee: Raypak Produkten B.V., Kerkrade, Netherlands

[21] Appl. No.: 945,908

[22] Filed: Sep. 26, 1978

[30] Foreign Application Priority Data

Oct. 5, 1977 [NL] Netherlands ..... 7710927

[51] Int. Cl.[2] ..... F23B 5/00

[52] U.S. Cl. ..... 110/326; 110/147

[58] Field of Search ..... 110/147, 322, 323, 324, 110/325, 326, 163; 126/307 R; 122/503

[56] References Cited

U.S. PATENT DOCUMENTS

| | | | |
|---|---|---|---|
| 1,169,784 | 2/1916 | Farber | 110/326 |
| 1,340,907 | 5/1920 | Muhlfeld | 110/325 |
| 1,777,818 | 10/1930 | Willett | 110/324 |
| 2,335,152 | 11/1943 | Lacerda | 110/324 |
| 2,515,701 | 7/1950 | De Vries | 110/326 |

*Primary Examiner*—Edward G. Favors

*Attorney, Agent, or Firm*—Browdy and Neimark

[57] ABSTRACT

A gas-fired boiler installation provided with a combustion space being upwardly in communication with a flue and at the bottom being confined by a burner bed. Between the combustion space and the flue there is disposed a draft interrupter, to which at the top in the central zone thereof the flue is connected and wherein there is present a pair of baffle grates which each extend obliquely upwardly towards and to adjacent the top end of one of two oppositely disposed sides of the draft interrupter, and having grate bars extending substantially parallel to said sides and, seen in cross section, extend upwardly towards the central zone of the draft interrupter.

9 Claims, 2 Drawing Figures

DRAFT INTERRUPTER OF A GAS-FIRED BOILER INSTALLATION

Figure 1:
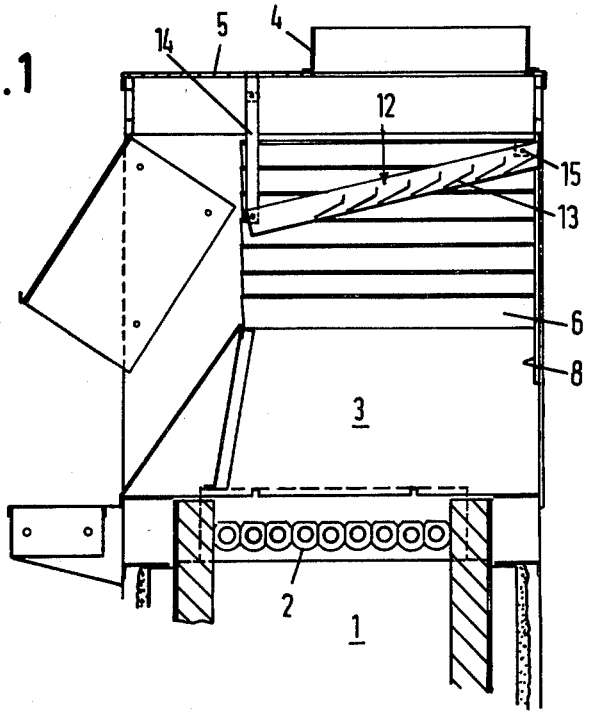

The present invention relates to a gas-fired boiler installation with control of the supply of combustion components, provided with a combustion space that is upwardly in communication with a flue and at the bottom is confined by a burner bed with atmospheric burners with interposed venturi tubes and comprising passages for secondary air disposed between the elements of the burner bed, there being disposed between the combustion space and the flue a draft interrupter to which at the top in the central zone thereof the flue is connected.

In this type of boiler installation substantially no or very little chimney draft is required for the supply of combustion air, since the combustion gas injected via the venturi tubes and the burners into the combustion space draws in the primary air, while the flames above the burner bed produce sufficient draft to cause the secondary air to enter the combustion space. The chimney draft produced in the flue is therefore only necessary for discharging the combustion products. Since said chimney draft required for discharge of combustion products may adversely affect the useful effect of the combustion process, the influence of said draft on the combustion space should be substantially excluded, for which purpose the so-called draft interrupter is supplied.

However, the chimney draft may vary strongly in dependence of the flue and the temperature distribution occurring therein, which in proportion to the varying capacity with which the installation is in operation, as well as the preceding operating time, is subject to considerable differences. The occurring differences in the chimney draft produce irregularities in the discharge of the combustion products or the flue gas, so that when the required provisions have not been properly arranged, there will sometimes be produced flue gas leaks, with the flue gas freely flowing into the space wherein the installation is arranged. It will be clear that in general it will be a condition for the installation that said flue gas leak is excluded.

When, in order to meet this requirement, an overcapacity for the flue gas discharge would be imparted to the flue, so that variations in chimney draft may be controlled, there would be permanently installed an excessive air discharge for the arrangement space, which also has to be qualified as inadmissible. The draft interrupter should therefore be provided with means for controlling the chimney draft and the flue gas discharge. Dynamically operating control means in the flue or the draft interrupter have as drawbacks the vulnerability and the increased cost price as well as the maintenance cost of the installation. Static control means or constructions on the draft interrupter serving for this purpose require in each installation adaptation to the size and the capacity thereof in view of an adequate effect, so that they constitute a source of recurrent cost price increases.

It is the object of the present invention to avoid these drawbacks.

In a gas fired boiler installation of the above described type, the draft interrupter in the embodiment according to the invention is provided with a pair of baffle grates, each grate extending obliquely upwards towards and to adjacent the top of one of two oppositely disposed sides of the draft interrupter, the grate bars extending substantially parallel to said sides and, seen in cross section, extend upwardly towards the central zone of the draft interrupter. Preferably the grate bars, seen in cross section, have a curved form with curvature centers disposed at the side of the bars facing towards the central zone of the draft interrupter, while, also considered preferably in vertical projection, they substantially contact or overlap each other.

Said baffle grates have as effect that in case of larger quantities of through-flow flue gas per unit of time, this is conducted by the baffle grate bars in shorter curved path to the central zone beneath the flue connection, thus following the path of lesser resistance, while in case of lesser quantities of flue gas, this follows the tendency to flow via the angular zones of the draft interrupter to the flue gas connection, thus producing more turbulence which increases the through-flow resistance, so that to a lesser degree air from the arrangement space taking the place of flue gas is discharged.

In particular the baffle grates according to the invention are advantageous if these are applied in broad boiler installations, whereby dead angles are produced in the draft interrupters, so that there exists the hazard that flue gasses on account of the slight chimney draft would not escape through the flue, with the above described adverse effect. Through application of the baffle grates according to the invention, it is ensured, however, that already in the lower zones the flue gasses are conducted towards the center of the draft interrupter, thus being discharged in the required manner via the flue. The baffle grates are inexpensive and can be easily applied in suitable dimensions in installations of varying dimensions.

The effect of the baffle grates can be reinforced by the effect of a downdraft grate according to the invention extending closely underneath the connection of the flue obliquely downwardly towards the open side of the draft interrupter between the baffle grates and whose grate bars extending substantially parallel to said open side, seen in cross section, likewise extend obliquely downwardly towards said open side. The grate bars of the downdraft, seen in vertical projection, may substantially contact or overlap each other.

Figure 2:
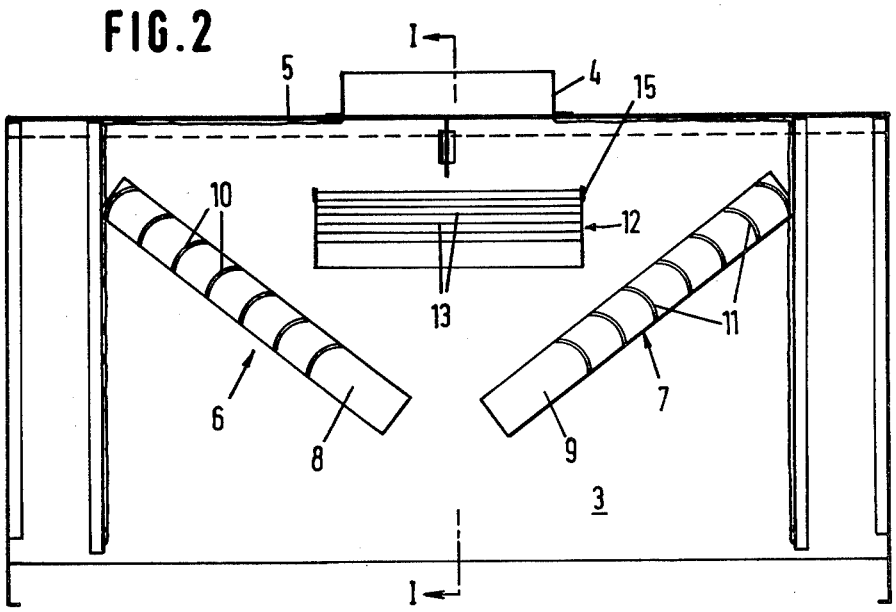

One embodiment of the invention will now be described, by way of an example, with reference to the accompanying drawings, diagrammatically showing in:

FIG. 1 in vertical cross section on the line I—I in FIG. 2 a part of an installation according to the invention; and FIG. 2 the draft interrupter of FIG. 1, in vertical cross section, the cross sectional plane being perpendicular to the cross sectional plane of FIG. 1.

In the drawing 1 indicates the top end of the combustion space of a gas fired boiler installation, by 2 is indicated a bed of heat exchanging tubes and by 3 the draft interrupter, which except for the additional grates, is of a known construction. The connection pipe length 4 for the flue, not shown, is in a central zone of the top wall 5 of the draft interrupter 3.

In the draft interrupter 3 there are disposed two baffle grates 6 and 7 mutually mirror-symmetrical relative to a meridian plane of the connection pipe length 4. The grates 6 and 7 comprise an assembly strip respectively 8 and 9 whereon are welded the grate bars 10, 11 respectively. The strips 8 and 9 are secured against the back wall of the draft interrupter in a manner not shown, e.g. by welding or by means of screwed bolts.

The bars 10 and 11 project across the space of the draft interrupter from the back side to the front side, the hollow side of their curved cross section facing towards the meridian plane of the connection pipe length 4.

Underneath the connection pipe length 4 there extends the downdraft grate 12 obliquely downwardly towards the open front side of the draft interrupter 3, the grate bars 13 of which extending to the baffle grates 6 and 7, likewise seen in cross section, sloping forwardly. The grate 12 is suspended by means of rods 14 and eye plates 15, so that the gradient of the grate 12 can be varied by choosing rods 14 of different length.

It will be clear that also the baffle grates 6 and 7 might be suspended by means of rods, thereby making their gradient adjustable.

I claim:

1. A gas-fired boiler installation with control of the supply of combustion components, provided with a combustion space that upwardly is in communication with a flue and which is confined at the bottom side by a burner bed having atmospheric burners with interposed venturi tubes and passages for secundary air arranged between the elements of the burner bed, whereby between the combustion space and the flue there is disposed a draft interrupter, to which at the top side in the central zone thereof is connected the flue, characterised by two baffle grates, each grate extending obliquely upwardly towards and to adjacent the top end of one of two oppositely disposed sides of the draft interrupter, and the grate bars of which extend substantially parallel to said sides and, seen in cross section, extend upwardly towards the central zone of the draft interrupter.

2. An installation according to claim 1, characterised in that the grate bars, seen in cross section, have a curved form with curvature centres lying at the side of the bars facing towards the central zone of the draft interrupter.

3. An installation according to claim 1 or 2, characterised in that the grate bars, seen in vertical projection, substantially contact or overlap each other.

4. An installation according claim 1 or claim 2, characterised by a downdraft grate extending closely underneath the connection of the flue obliquely downwardly towards the open side of the draft interrupter between the baffle grates, the grate bars thereof extending substantially parallel to said open side, seen in cross section, likewise extending obliquely downwardly towards said open side.

5. An installation according to claim 4, characterised in that the grate bars of the downdraft grate, seen in vertical projection, substantially contact or overlap each other.

6. A gas-fired boiler installation with control of the supply of combustion components, provided with a combustion space that upwardly is in communication with a flue and which is confined at the bottom side by a burner bed having atmospheric burners with interposed venturi tubes and passages for secondary air arranged between the elements of the burner bed, whereby between the combustion space and the flue there is disposed a draft interrupter, to which at the top side in the central zone thereof is connected the flue, characterized by two baffle grates, each grate extending obliquely upwardly towards and to adjacent the top end of one of two oppositely disposed sides of the draft interrupter, and the grate bars of which extend substantially parallel to said sides and, seen in cross section, extend upwardly towards the central zone of the draft interrupter, further in that the aforesaid grate bars, seen in vertical projection, substantially contact or overlap each other, and including a downdraft grate extending closely underneath the connection of the flue obliquely downwardly towards the open side of the draft interrupter between the baffle grates, the grate bars of said downdraft grate extending substantially parallel to said open side, seen in cross section, likewise extending obliquely downwardly towards said open side.

7. An installation according to claim 6 characterized in that the grate bars of the downdraft grate, seen in vertical projection, substantially contact or overlap each other.

8. A gas-fired boiler installation with control of the supply of combustion components, provided with a combustion space that upwardly is in communication with a flue and which is confined at the bottom side by a burner bed having atmospheric burners with interposed venturi tubes and passages for secondary air arranged between the elements of the burner bed, whereby between the combustion space and the flue there is disposed a draft interrupter, to which at the top side in the central zone thereof is connected the flue, characterized by two baffle grates, each grate extending obliquely upwardly towards and to adjacent the top end of one of two oppositely disposed sides of the draft interrupter, and the grate bars of which extend substantially parallel to said sides and, seen in cross section, extend upwardly towards the central zone of the draft interrupter and further characterized in that the aforesaid grate bars, seen in cross section, have a curved form with curvature centres lying at the side of the bars facing towards the central zone of the draft interrupter, and that the aforesaid grate bars, seen in vertical projection, substantially contact or overlap each other, and including a downdraft grate extending closely underneath the connection of the flue obliquely downwardly towards the open side of the draft interrupter between the baffle grates, the grate bars of said downdraft grate extending substantially parallel to said open side, seen in cross section, likewise extending obliquely downwardly towards said open side.

9. An installation according to claim 8, characterized in that the grate bars of the downdraft grate, seen in vertical projection, substantially contact or overlap each other.

* * * * *